US005642525A

United States Patent [19]

Ketola

[11] Patent Number: 5,642,525

[45] Date of Patent: Jul. 1, 1997

[54] ELBOW PROTECTIVE GARMENT

[76] Inventor: Linda J. Ketola, 4015 B Palm Bay Cir., West Palm Beach, Fla. 33406

[21] Appl. No.: 570,002

[22] Filed: Dec. 8, 1995

[51] Int. Cl.[6] ..... A41D 13/08

[52] U.S. Cl. ..... 2/16; 602/63

[58] Field of Search ..... 2/2, 16, 24, 20, 2/22, 59, 61; 602/62, 63, 64, 65

[56] References Cited

U.S. PATENT DOCUMENTS

| | | | |
|---|---|---|---|
| 2,459,992 | 1/1949 | Cimino | 2/16 |
| 3,322,118 | 5/1967 | Sotherlin | 2/16 |
| 4,856,112 | 8/1989 | Effle | 2/16 |
| 4,914,753 | 4/1990 | Chang | 2/16 |
| 4,951,317 | 8/1990 | Gray et al. | 2/16 |
| 5,168,577 | 12/1992 | Detty | 2/16 |
| 5,187,813 | 2/1993 | Klein | 2/16 |

*Primary Examiner*—C. D. Crowder
*Assistant Examiner*—Larry D. Worrell, Jr.
*Attorney, Agent, or Firm*—Kenneth E. Merklen

[57] ABSTRACT

A protective garment for protecting portions of an extremity of the body includes a longitudinally openable, modified tubular-like body with a cuff connected to each end of the body. One of the two cuffs is circumferentially closed and the other cuff of the two cuffs is circumferentially openable. A pull is provided, on the closed cuff, for manupilating the open garment. A zipper connected along the longitudinal opening of the body and the opening in the circumference of the openable cuff is provided so that the body and the openable cuff may be closed. Each cuff is fabricated from a stretchable material for securing the garment to the extremity.

4 Claims, 3 Drawing Sheets

ELBOW PROTECTIVE GARMENT

BACKGROUND OF THE INVENTION

1. Field of the Invention

The present invention relates to body part protective garments or bandages, particularly adapted for wearing on the arm, for covering and protecting the elbow of a person, from external contact and/or pressure, in the area of the nerve center of the elbow.

2. Prior Art

Body part protective garments or bandages for use on the arm or leg of a person, for covering and/or protecting a portion of the arm or the leg, such as the elbow, ankle or knee joint, for example, appear to fall into one of two general type or category; those that are of fully open construction and are essentially a wrap around garment or bandage and those that are of closed, such as tubular or modified tubular, construction and are essentially a slide-on garment or bandage.

The fully open or fully openable protective garment or bandage, which normally has some means to close the protective garment and to hold the garment closed over the area to be protected, normally requires at least two hands for positioning the protective garment on or about that portion of the arm or the leg to be protected and to hold and close the garment around the body part. The use of two hands to position, hold and close such protective garment or bandage around a body part is convenient and conducive to self-installation when the protective garment is used on the leg, such as the ankle or on the knee, for example, however, when a fully open or fully openable protective garment is used on the arm, such as on the elbow, for example, self-installation becomes a problem since two hands of the person installing the protective garment about his elbow are not available to manipulate, to hold in place and to close the protective garment.

As for the protective garments of tubular or modified tubular construction, these may be positioned on the elbow of a person using only one hand but the protective garments must be slid on to and along the surface of the skin of the arm and in sliding over the skin, the protective garment slides over the area to be protected from contact, invasion and/or pressure and the protective garment itself often commits the very act from which the garment is designed to protect the elbow.

Examples of fully open and/or fully openable protective garments or bandages for use on the arm or on the leg are taught in U.S. Pat. Nos.:

1,304,558 to Grau 1919

2,140,598 to Rhorer 1937

3,648,291 to Pankers 1972

Grau teaches an elbow shield in the form of a longitudinally open sleeve that may be pulled together by pairs of straps spaced along the longitudinal opening. Rhorer teaches an elbow pad with upper and lower adjustable straps or closures. The Rhorer pad covers only a portion of the elbow and avoids a wrap around pad, only the adjustable straps encircling the arm to hold the pad in place. Pankers, on the other hand, teaches a fully openable, wrap around elbow protective sleeve. The sleeve is fully openable, along it length, so that the elbow may be placed or positioned in the open protective sleeve and the sleeve is then wrapped around the elbow and closed. These elbow protective bandages or garments each require at least two hands to position the garment or bandage on or about the elbow and to hold in position and close about the elbow and are therefore not installable about the elbow by the person wearing the protective garment.

Examples of tubular or modified tubular construction protective garments are taught in U.S. patent to:

| | | |
|---|---|---|
| Guttman | 3,266,058 | 1966 |
| Sotherlin | 3,322,118 | 1967 |
| Gaylord, Jr. | 3,990,446 | 1976 |
| Boone | 4,150,442 | 1979 |
| Bloom | 4,166,463 | 1979 |
| Gamm | 4,632,106 | 1986 |
| Detty | 5,168,577 | 1992 |
| Brandt, et al | 5,185,000 | 1993 |

Sotherlin teaches a slide-on protective sleeve of stretch material for the heel of the foot or for the elbow, that is of fully closed construction. The stretchable sleeve slides on the extremity, with the whole of the sleeve sliding over some of the surface of the skin of the extremity over which the protective garment is place. The U.S. patents to Guttman; Gaylord, Jr.; Boone; and, Brandt, et al each teach protective bandages or methods for providing protection for an elbow of the arm or a heel of the foot, the protection bandages constructed in the form of a flexible, tubular or modified tubular bandage or garment, which slides on over the part of the body to be protected. The U.S. patents to Gamm and to Detty each teach more rigid, tubular protection bandages having seams removed from the bending points or areas covered by the tubular bandages. The Bloom teaching covers an elastic tubular support for the foot and ankle.

The U.S. Pat. No. 3,406,406 issued to Lutz in 1968 teaches a body joint support showing several different constructions. The full, longitudinally open construction carries the disadvantages of the former group of three (3) U.S. patents set forth above while Lutz also teaches a slide-on construction which carries the disadvantages of other slide-on protection and support bandages, such as those in the latter group of eight (8) U.S. patents set forth above.

Those protective garment or bandages that are of the slide-on type, may be installed on the arm or the leg, using only one hand. This makes the slide-on protective garment more easily installable by the person wearing the protective garment, when it comes to installing or positioning the garment on the arm. However, since the tubular protective garment slides over the area to be protected, this is often undesirable as contact with the surface of the skin of the area to be protected may be a contact to be avoided because of the extreme sensitivity of the area. This is especially true when there has been a damage to the nerve center of the elbow.

SUMMARY OF THE INVENTION

The present invention provides a greatly improved protective garment or bandage that is partially tubular and partially open, with the tubular section of the protective garment positioned on the garment so that when the garment is being installed and/or positioned on the arm or the leg and about the area of the arm or the leg to be protected by the protective garment, the protective garment will not slide over the surface of the skin of the area of the arm or the leg to be protected.

The protective garment or bandage of the present invention includes a fully, longitudinally openable and closable body with connecting upper and lower cuffs attached to each end, respectfully, of the body. The connecting upper cuff is openable and closable, along with the body while the lower cuff is a circumferentially closed cuff. A means to open and close the fully openable and closable body and upper cuff is provided. The greatly improved protective garment of the present invention is particularly adapted for protectively covering a joint on the arm, such as the elbow, for example, because the protective garment may be easily installed and/or positioned on the arm, by a person using the garment, using only one hand of the person wearing the protective garment. This advantage makes the present improved protective garment user-friendly.

In addition the present invention, which has one closed cuff and a fully openable and fully closable body and second cuff, has the convenience of slide-on retention, accorded by the closed, lower cuff, when the garment is being adjusted or positioned on the arm or on the leg, and the advantage of avoiding unwanted sliding contact with the area to be protected, by the body and the upper cuff during adjustment or positioning, making the improved protective garment user-comfortable.

The protective garment of the present invention is also user-convenient in that there is provided a versatile protective garment defined by a lower closed cuff, attached to the lower end of a fully, longitudinally openable and closable body and having a circumferentially openable and closable cuff attached to the upper end of the body, which permits the protective garment to be easily and conveniently slipped on, over the extremity and slid into position, requiring only one hand for manipulation by the user of the garment.

Incorporated into the closed lower cuff is a finger pull, which may be defined as a loop coupled to and extending from the outer periphery of the closed loop. The finger pull provides a loop for inserting one's finger into the loop and manipulate the closed cuff into position on the arm, for example. The finger pull may be made from an elastic, resilient material so that the finger pull loop when not used to position the closed lower cuff on the arm, for example, lays close to the exterior of the closed cuff but expands when a finger is inserted into the loop and permits one using the protective garment to use the loop to pull the closed cuff over one's extremity, positioning the protective garment on one's own arm, for example, without further assistance of other persons. The finger pull provides a convenient means for moving the closed lower cuff longitudinally along and/or rotationally about the arm, for example, without the need for moving the closed lower cuff over the area to be protected, making the protective garment user-friendly and user-convenient. Once the closed cuff is in position on one's arm, for example, the closed cuff of the protective garment will hold the lower portion of the garment in position and the garment may be closed about the extremity by closing the closure means, such as a zipper, for example.

Alternatively, the open portion of the protective garment may be used to position the protective garment on the extremity. The open portion of the protective garment may be gripped and closed lower cuff of the open protective garment may be pulled into position on the extremity, without the need for pulling the closed lower cuff over the area to be protected.

When the closed lower cuff is positioned as desired, the open body and upper cuff may be extended over the area to be protected. The open body and cuff may then be closed by the closure means about the area to be protected. Positioning of the protective garment may thus be accomplished without the body and the upper cuff of the garment having come in contact with the surface of the skin of the area to be protected.

Preferably, both the lower and the upper cuffs may be made of a stretchable fabric or an elastic material, that is resilient, so that the closed cuff and the openable cuff, when closed, may resiliently hold the protective garment in place on a portion of the arm or a portion of the leg, as desired. The body and openable cuff are provided with a zipper, extending along the length of the opening so that the opening in the body and the openable cuff may be closed, as desired. Also, the finger pull is preferably made from an elastic, stretchable, resilient fabric or material so that when not used, the finger pull will lay adjacent the external surface of the closed lower cuff. Although a zipper is the preferred opening and closing means for use on the present protective garment, other opening and closing means, such as snaps, or hook and eye, or VELCO hook and loop fastener or a combination thereof, for example, may be used, if desired. When the present invention is positioned on the elbow, for example, the body and upper cuff are open. The closed lower cuff is pulled over the hand, using the finger pull or the open body and open upper cuff as a means to draw or slide the closed, lower cuff over the hand. The wrist and fore arm are slid through the closed cuff until the closed cuff is positioned on the upper fore arm. The open body is extended into position along the elbow and the open upper cuff is positioned above the elbow. While the closed lower cuff holds the protective garment in place on the fore arm, the zipper closure means may be closed so as to close the body of the garment longitudinally along and about the elbow, and close the upper cuff about the lower portion of the upper arm, securing the protective garment about the elbow, without having any part of the protective garment make sliding contact with the elbow and with using only one hand of the wearer to position the protective garment about the elbow. The same procedure is used to position the protective garment on other parts of the body, with similar results.

OBJECTS

It is therefore an object of the present invention to provide a protective garment or bandage that may be slid along the arm or the leg without making sliding contact with the area of the arm or the leg intended to be protectively covered.

Another object is to provide a protective garment or bandage that may be positioned on the arm using only one hand of the wearer of the protective garment.

A further object is to provide a protective garment or bandage for protectively covering the elbow of a person where the protective garment is user-friendly, user-comfortable and user-convenient.

These and other objects will become apparent when reading the following description of the invention, referenced to the drawings in which:

DETAILED DESCRIPTION OF THE INVENTION

Figure 1:
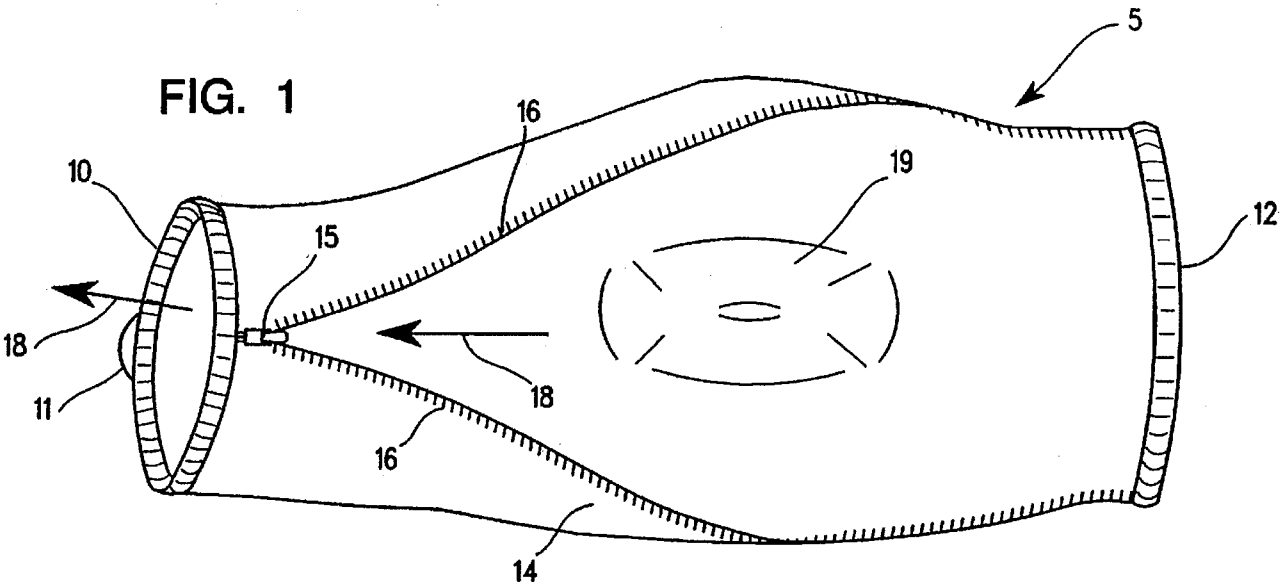
FIG. 1 is a representation of the invention shown in top view, with the closure means open.
Figure 1A:
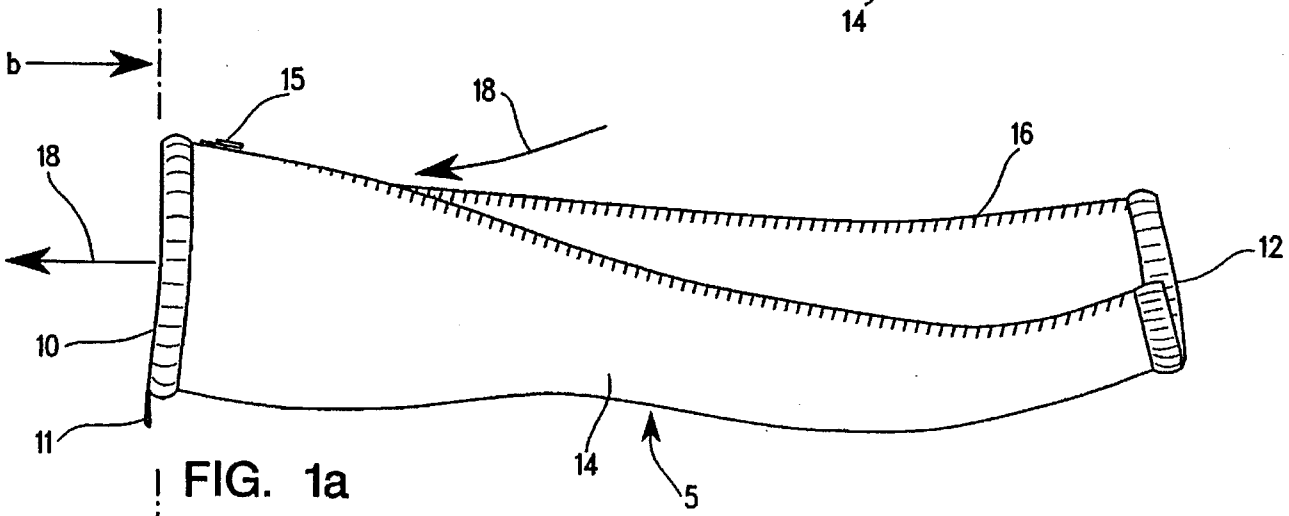
FIG. 1*a* is a representation of the invention shown in FIG. 1, in side elevation view.

FIGS. 1 and 1*a* represent an improved protective garment or bandage of the invention which is shown in open condition. The garment includes a lower closed cuff or collar 10 and an openable upper cuff or collar 12 with a garment body 14 there between. A finger pull 11 is shown in exaggerated condition, as a loop extending from the outer periphery of the cuff 10. The body and upper cuff are openable and closable by a zipper 16 that begins above the lower cuff and extends longitudinally along the body and has closable ends at the upper cuff so that the upper cuff is closed by the zipper. The zipper includes a slide 15 that, engages the teeth of the zipper to close the zipper when slid along the open zipper and, when slid along the closed zipper separates the teeth of the zipper to open the zipper, as is well known. Alternatively, the zipper may be replaced with a VELCRO hook and loop fastener, if desired. However, the use of a longitudinally disposed zipper for opening and closing the body and upper cuff of the protective garment is preferred.

Figure 1B:
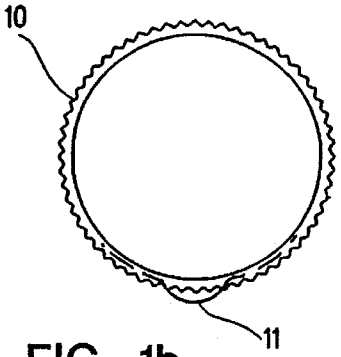
FIG. 1*b* is a representation of the invention as viewed along line b—b of FIG. 1*a;*

The finger pull 11 provides a loop into which a finger may be inserted and accords a close and convenient means for moving the closed lower cuff into position on the arm or the leg, without the need of further assistance. FIG. 1b shows the finger pull 11 in an exaggerated form, as the finger pull will lay on the external periphery of the closed lower cuff, when not in use.

The lower cuff 10 is circumferentially closed and is connected, at it one end to the lower end of the body 14. The cuff 10 is preferably fabricated from an elastic, expandable or stretchable fabric or material, that has resilient characteristics. The elasticity and resilience function to make the garment self-securable when the garment is put on the body. When, for example, the garment is put on the arm, the body 14 and upper cuff 12 are open and the hand (not shown) is inserted or thrust through the lower cuff 10, from the body side of the cuff, in the direction of the arrow 18. The open body and upper cuff define an alternate means for single handedly holding the garment while the hand is moved through the lower cuff 10, in the direction of the arrow 18, the use of the finger pull, inserting a finger therein being the preferred means. The resilience of the closed lower cuff holds the garment on the extremity so that only one hand is needed to hold and control or manipulate the garment while the hand, wrist and lower forearm, for example, are passed through the lower cuff and/or the garment is being drawn into position. With the combination of the circumferentially closed lower cuff and the open body and open upper cuff the improved protective garment is put on the arm using only one hand and the open body and upper cuff do not come in premature contact with the arm.

When the protective garment is to be used to cover and protect the elbow on the arm, for example, the protective garment may be positioned on the arm, with only the lower cuff touching the forearm, substantially below the elbow. The open body and the open upper cuff avoid contact with the arm. This is shown in FIG. 2.

Figure 2:
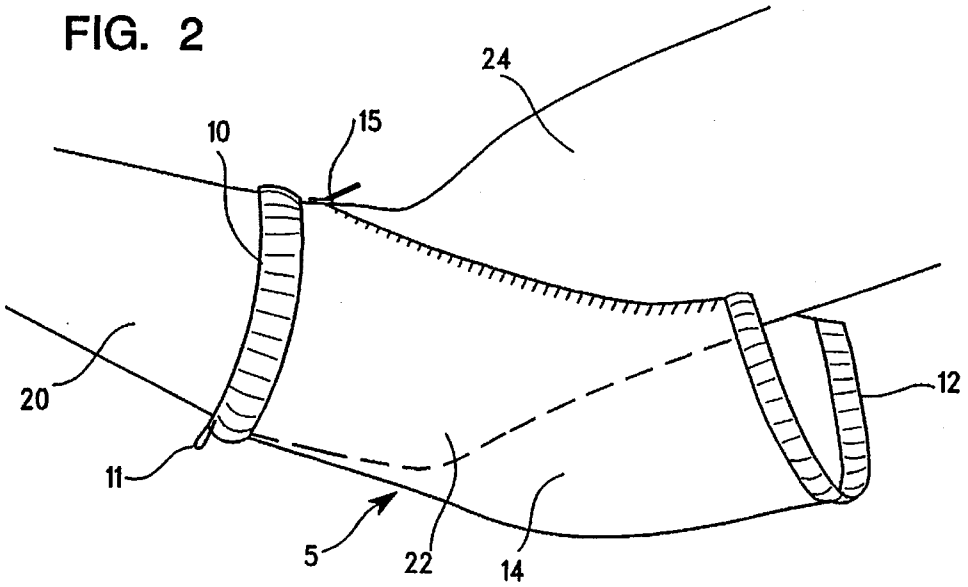
FIG. 2 is a representation of the invention, in a side elevation view, where the lower cuff is slid up the arm in preparation for positioning the invention over the elbow.
Figure 2A:
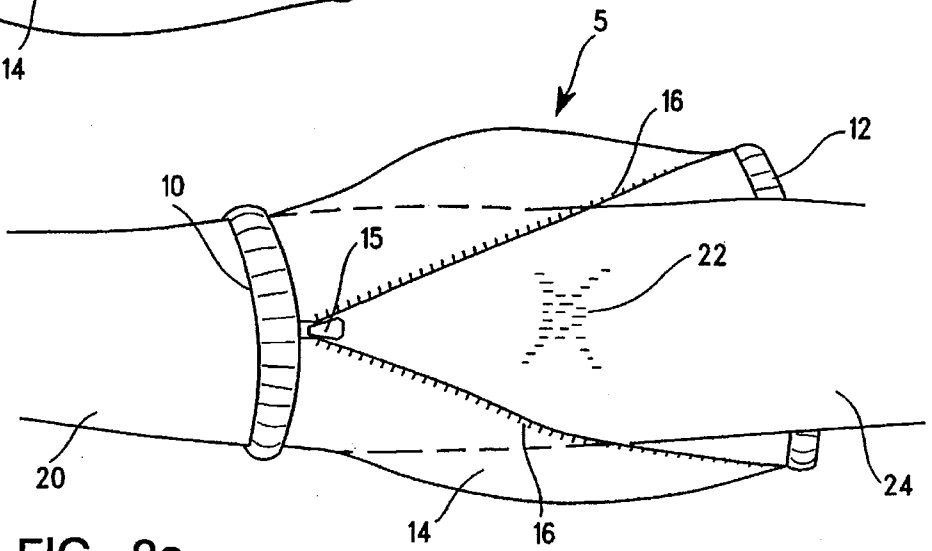
FIG. 2*a* is a representation of the invention shown in FIG. 2, in a top view.

FIGS. 2 and 2*a* represent the protective garment or bandage 5 with the lower cuff 10 slid up the forearm 20 of the wearer, with the body 14 of the protective garment open and positioned under the elbow 22. The open upper cuff 12 at the upper end of the open body 14 is positioned beyond the elbow so as to be under a lower position of the upper arm 24.

The lower cuff 10 functions as a retainer to hold the protective garment on the arm when the garment is being positioned on the arm by the wearer. The positioning of the protective garment requires the use of only one hand, making the garment user-friendly. In addition, the lower cuff, although it makes contact with the surface of the skin on the arm does not make contact with the portion of the arm that the protective garment is intended to protect. Thus the invention is most practical for use on an elbow where the nerve center there of is especially sensitive to touch and/or pressure. Here the garment is user-comfortable.

Figure 3:
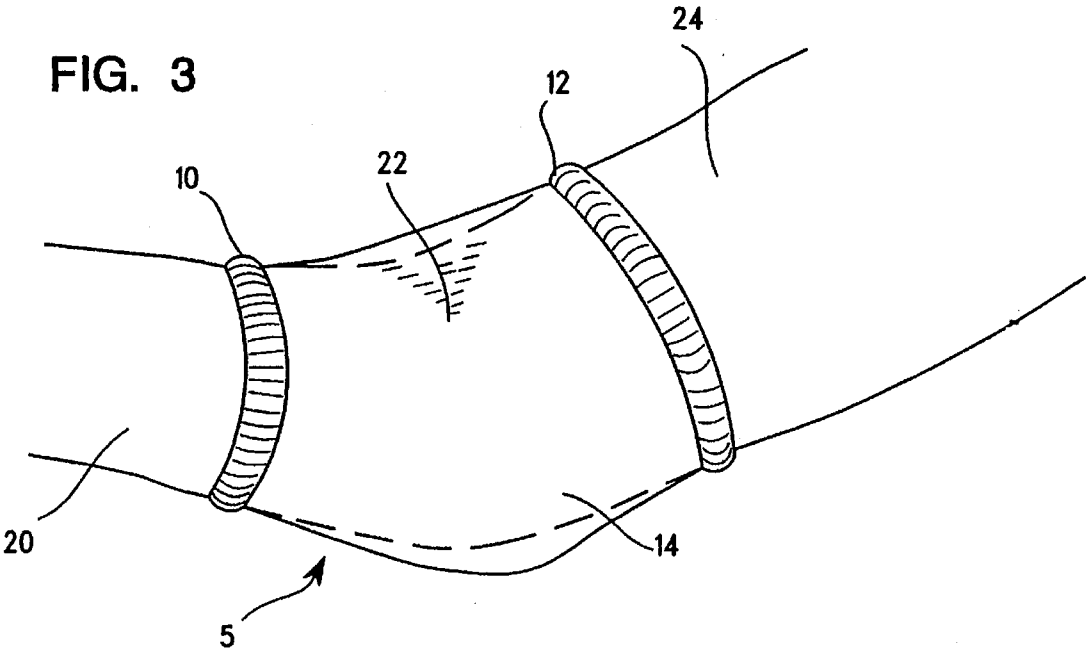
FIG. 3 is a representation of the invention in a side elevation view where the invention is closed around the elbow.
Figure 3A:
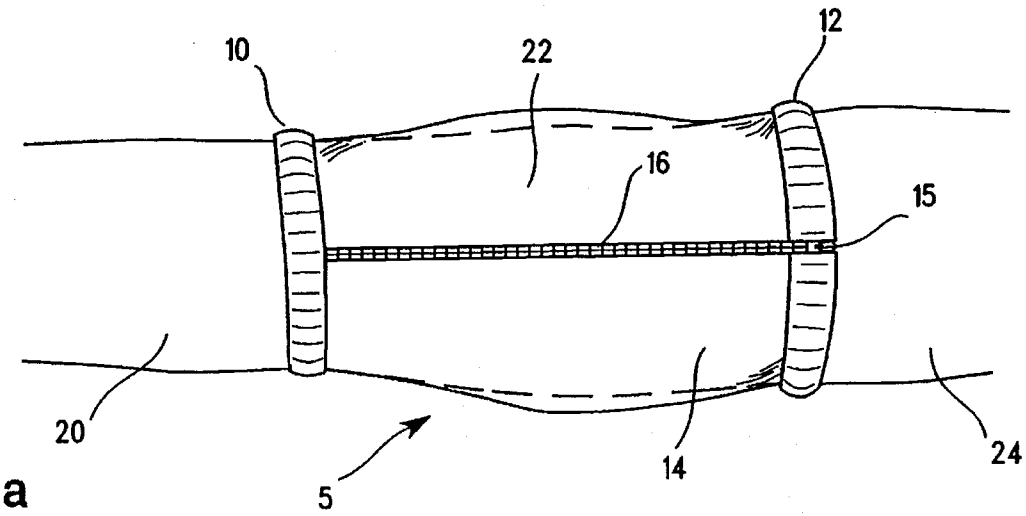
FIG. 3*a* is a representation of the invention as shown in FIG. 3, in a top view.

The protective garment can be closed about the elbow such as represented in FIGS. 3 and 3*a*, by closing the zipper while the lower cuff holds the garment in position on the arm. Closure of the zipper is accomplished by pulling the slide 15 up the zipper to effect meshing of the zipper teeth, which is well known.

The body of the protective garment may include a pad such as 19 shown in FIG. 1.

The body of the protective garment is preferably fabricated from a soft, thick, woven material, and has full center cut, so that when the body is closed by the closure means the body defines a modified tube having an enlarged or balloon-like central area. The body which is open longitudinally, is connected to a circumferentially closed cuff at its lower end and an openable cuff at its upper end.

Each cuff is preferably fabricated from a stretchable fabric and has expandable and resilient characteristics. The body of the protective garment is preferably made from a soft thick loosely woven material that is absorbent, although other materials may be used. The longitudinal opening in the body begins at that part of the body that is connected to the lower cuff and extends longitudinally along the body to and including the upper cuff connected to the upper extremity of the body. The longitudinal opening is defined by a closure means, such as a zipper, for example, which extends along the length of the opening and across the cuff so that the body and upper cuff may be completely closed about that portion of the arm or leg on which the garment is worn.

It will be appreciated that both the lower and upper cuffs may be fabricated from a stretchable fabric or material and that the circumference of the lower cuff, for example, is such as to permit the hand or the foot of a person to pass through the cuff. The stretch and/or resilient capability of the material from which the cuffs are fabricated should be such as to comfortably hold the garment in place on the leg or arm. The cuffs function, when the upper cuff is closed, to secure the protective garment on the arm or the leg and permit the body of the garment to balloon between the cuffs forming a full or balloon-like protective cover for that portion of the body of the person between the two cuffs of the garment.

Although the protection garment is particularly designed to be used on the arm to cover and protect the elbow, the protective garment may be used, as desired to cover and protect other body parts, such as the wrist ankle or knee, for example.

Cuffs may be fabricated from elastic material or stretch fabric or any other stretch material, any of which is available in dry goods stores. The body of the garment may be fabricated from an open weave material available in dry goods stores.

Although the preferred finger pull is in the form of a loop connected to the closed lower cuff, the finger pull may be a short string extending from the closed lower cuff or a hole, such as a button hole designed to receive a portion of the finger, for example, or other means that may be grasped by thumb and fingers, for example, so as to exert a moving pressure on the closed cuff, to position the closed cuff, as desired.

It has been found that the protective garment may have a body length of eight (8) to (10) inches and a body width which graduates from eight (8)inches at the ends to fourteen (14) to sixteen (16) inches across the width of the central area of the body. This structure, when closed, provides a modified tubular body with a balloon-like center that provides a protective cover for the elbow, for example, when worn on the arm of a person and positioned about the elbow.

There has been described, with reference to the drawings, a novel protective garment or bandage especially useful for providing a protective cover for the elbow but may be use to provide a protective cover for other portions of the arm or the leg. Although a preferred embodiment of the invention has been represented in the drawings and described herein, and several alternate structures have been suggested other changes and modification may be made by those skilled in the art, without departing from the invention.

What I claim is:

1. A protective bandage for covering and protecting an elbow of a person, and for positioning and securing said protective bandage about said elbow without sliding contact between said protective bandage and said elbow, said protective bandage comprising:

a body having a length and a width defining a loose fitting body, an upper end and a lower end defining said length, and an opening extending along said length including said upper end and said lower end;

a lower cuff means, circumferentially closed, connected to said lower end for holding said body closed at said lower end and for securing said protective bandage about a forearm of said person, below said elbow covered by said body of said protective bandage;

an upper cuff means connected to said upper end of said body for securing said protective bandage on said person, above said elbow covered by said body, said opening extending across a circumference of said upper cuff means for opening said upper cuff means with said body for permitting direct access to said lower cuff means when said body and said upper cuff means are open;

a closure means connected to said body along said opening extending from said lower end to and including said upper end for closing said body about said elbow, said closure means connected to said upper cuff means for closing said upper cuff means for securing said protective bandage above said elbow; and a pull means connected to said lower cuff means and extending therefrom for exerting a moving force on said lower cuff means, when pulled, for moving and for positioning said protective bandage on said person prior to closing said body and said upper cuff means about said elbow.

2. A protective bandage as in claim 1 and in which said pull means is defined by a resilient, stretchable loop coupled to said first cuff means for inserting a finger into said pull means for moving said first cuff means.

3. A protective bandage as in claim 1 and in which said closure means is a zipper.

4. A protective bandage as in claim 1 and in which said closure means is a VELCO hook and loop fastener.

* * * * *